US005197201A

United States Patent [19]

Salin

[11] Patent Number: 5,197,201

[45] Date of Patent: Mar. 30, 1993

[54] PROCESS FOR DRYING TIMBER

[75] Inventor: Jarl-Gunnar Salin, Esbo, Finland

[73] Assignee: Ekono Oy, Esbo, Finland

[21] Appl. No.: 944,014

[22] Filed: Sep. 11, 1992

Related U.S. Application Data

[63] Continuation of Ser. No. 671,347, Mar. 19, 1991, which is a continuation-in-part of Ser. No. 476,366, Jul. 23, 1990, abandoned.

[30] Foreign Application Priority Data

Sep. 27, 1988 [FI] Finland ..... 884428

[51] Int. Cl.[5] ..... F26B 5/04; F26B 21/06

[52] U.S. Cl. ..... 34/16.5; 34/191; 34/209

[58] Field of Search ..... 34/16.5, 191, 209

[56] References Cited

U.S. PATENT DOCUMENTS

| | | | |
|---|---|---|---|
| 1,729,675 | 10/1929 | Lecocq | 34/191 X |
| 2,370,886 | 3/1945 | Solberg | 34/191 X |
| 2,538,888 | 1/1951 | Smith | 34/191 X |
| 3,422,545 | 1/1969 | Wilson | 34/16.5 |
| 3,434,222 | 3/1969 | Malmquist | 34/16.5 |
| 4,127,946 | 12/1978 | Buchholz | 34/16.5 X |
| 4,610,098 | 9/1986 | Duc | 34/209 |

FOREIGN PATENT DOCUMENTS

| | | | |
|---|---|---|---|
| 335918 | 4/1977 | Austria . | |
| 787830 | 12/1980 | U.S.S.R. | 34/16.5 |
| 554930 | 7/1943 | United Kingdom | 34/191 |

*Primary Examiner*—Henry A. Bennet
*Assistant Examiner*—Christopher Kilner
*Attorney, Agent, or Firm*—Dressler, Goldsmith, Shore, Sutker & Milnamow, Ltd.

[57] ABSTRACT

The invention relates to a process for drying timber in which the timber is fed gradually through a drying tunnel while at the same time being permeated by a drying air with a temperature below 80° C. transported primarily in the longitudinal direction of the tunnel. Said drying tunnel is divided into two separate sections with said drying air divided into two circulating substreams, of which one flows through the first section of the tunnel in the direction of motion of the timber and the other through the second section of the tunnel contrary to the direction of motion of the timber, after which said substreams are conditioned and returned to their section.

9 Claims, 5 Drawing Sheets

PROCESS FOR DRYING TIMBER

This application is a continuation of application Ser. No. 671,347, filed Mar. 19, 1991, which is a continuation-in-part of application Ser. No. 476,366, filed Jul. 23, 1990, now abandoned.

BACKGROUND OF THE INVENTION

The present invention relates to a process for drying timber in a drying tunnel through which the timber is fed stepwise and is there permeated by drying air below 80° C. which flows in the longitudinal direction of the tunnel. In particular, the present invention relates to such a process in which the drying tunnel is divided into two sections separated by an intervening space and with the drying air divided into two circulating substreams. By means of the process, improved quality of the dried timber is obtained with unchanged drying time or, alternatively, a shorter drying time with unchanged quality level.

Sawed timber should be dried to a moisture content of approximately 15–22%, calculated on the dry weight of the timber, in order that the timber can be stored without biological attack in the form of mold, etc. For drying timber at sawmills, two main types of drying kiln are employed, so-called compartment kilns and progressive kilns (tunnel kilns), whereas timberyard drying has practically ceased.

In the compartment kiln, the entire quantity of timber which is to be dried is loaded into the kiln at one time and stacked in piles in known fashion. In principle, any drying schedule whatsoever can be achieved in a kiln of this type. The drying schedule is determined by the temperature and moisture content of the drying air and its speed of flow through the timber pile and their variations during the drying period. It is therefore possible in this type of kiln to employ what is, by some criterium, the optimum drying schedule. This is the principal advantage of this kiln. The disadvantages include a relatively high energy consumption and that these kilns cannot be made especially large because otherwise the drying climate would vary too much in different parts of the timber load.

In a conventional single-stage progressive kiln the piles of timber move stepwise through the tunnel while new piles are loaded at regular intervals and at the same time dried piles are taken out from the other end of the tunnel. The drying air flows along the length of the tunnel in a counter-current direction through the piles. As the drying air flows through the piles it is cooled at the same time as its moisture content rises. Once the condition of the drying air which is fed into the tunnel and its speed have been chosen the changes in the temperature and moisture content of the air (i.e., the drying schedule) can no longer be controlled but depend only on the interaction of the wood with the air flow. Thus, unlike the compartment kiln, in a single-stage progressive kiln it is not possible to achieve any optimum drying schedule. Against this, the progressive kiln has the advantage that the energy consumption is appreciably lower since the air which leaves the kiln is almost saturated and also heat recovery can readily be obtained. Further, the progressive kiln can advantageously be constructed for high capacities, 10,000–20,000 $m^3$/annum.

A division of the progressive kiln into two stages has been proposed and has also come into use at some sawmills. In such a two-stage kiln, the drying air is introduced into the tunnel between the stages so that part flows in a countercurrent direction in the first stage of the kiln and part in a concurrent direction in the second drying stage. Compared with the single-stage progressive kiln, this two-stage progressive kiln has advantages primarily in regard to control technology as it has some self-regulating properties.

In the choice of the drying schedule for a compartment kiln or of the condition of the inlet air for a progressive kiln, there are two main requirements which should be satisfied. On the one hand the final moisture content of the timber after the desired drying time should be that which is aimed for, and on the other hand the quality loss of the timber in drying should be as little as possible, or at least acceptable. In general, the speed of drying increases as the difference between the dry-bulb and wet-bulb temperatures of the air increases. The magnitude of the change in the quality of the timber is a more complicated function of the drying procedure, but roughly it can be said that the faster drying is carried out the greater are the quality losses. Thus, in general, it is a question of a compromise between slow drying with low throughput but good quality and fast drying with reduced quality. The compartment kiln has thereby achieved an increased importance for drying with preservation of quality since in such a kiln the drying schedule can be chosen in an optimum fashion. Drying can namely be carried out relatively fast without accentuating the quality loss.

Against the background of the aforesaid circumstances there has been a clear effort to try to construct progressive kilns with the characteristic advantages of this type but so that the disadvantage of the non-optimum drying schedule can be circumvented.

The quality loss of the timber in drying can be divided into two main components. One is that with high temperature levels and/or long drying times there is a flow of resin at knots, etc., together with a darkening of the surface of the timber. The other is the occurrence of checks in the timber. Of these two groups, check formation is, especially with thicker dimensions, clearly the more important. The cause of check formation can be explained in the following manner. In drying, the surface of the timber dries faster than the inner parts of the piece of timber because of the resistance to the movement of moisture within the material. When the fiber saturation point is reached, i.e., when the free water has been removed and only water bound to the wood substance remains, the wood starts to shrink. This means that an internal mechanical tensile stress arises in the surface of the timber. This tensile stress by shrinkage is balanced by a corresponding compressive stress in the inner parts of the timber. If the tensile stress in the surface layer exceeds the strength of the wood, a rupture takes place, i.e., surface checking occurs. Thus, it is clear that if the difference in moisture content between the surface of the timber and its inner parts (the moisture profile) is pronounced, the risk of check formation increases, i.e., in rapid drying the risk increases. The matter is complicated, however, by the fact that wood is not a purely elastic material but exhibits viscoelastic properties. This means, e.g., that if the surface of the timber is subjected for a longer time to tensile stress then creep occurs, i.e., there is a permanent extension of the surface layer. When drying has progressed so far that also the inner parts have reached the fiber saturation point, the surface has accordingly extended more than the inside and the stress pattern is then reversed so that the outside is subjected to compressive stress and the inner parts to tensile stress. Hence, during this latter phase of drying, internal checking of the timber can occur. Though these internal checks cannot be seen they are of great importance in possible subsequent working of the timber.

At elevated temperatures, the flow of resin and darkening of the surface is a problem for several wood species, especially softwoods. It is known from practice that the rate of quality change due to these phenomena usually doubles for every 10° C. increase in temperature. For this reason, temperatures above about 80° C. cannot be used in many cases. This fact emphasizes the need to control drying induced checking because stress relaxation through creep behavior of wood is slowed down when the temperature is low.

Even though both mechanisms of quality loss described above and the mechanisms of moisture transport have long been known at a qualitative level, the development of improved drying schedules has been almost exclusively empirical, i.e., based on direct experience concerning the final moisture content and quality which is obtained with the drying schedule which is tested. It can also be stated that the continuous measurement of the moisture content and profile of the timber during drying is admittedly possible but in practice very troublesome. On the other hand, so far, there exists no reliable method for the continuous measurement of the stress conditions in the timber or even for registration of when checks occur.

It has, however, now proved possible with the aid of physical and mathematical methods of calculation to predict in a reliable fashion on the one hand how the moisture content and moisture profile of the timber develops and varies in different drying climates, and on the other to predict on the basis of these profiles what stresses occur and thus the risk of check formation. Similarly, there are possibilities to estimate resin flow and the color change of the timber surface. Thus, the final moisture content of the timber with a given drying schedule can be calculated and also the quality loss can be predicted with such models.

SUMMARY OF THE INVENTION

The present invention is accordingly based on the discovery that if the direction of flow of the drying air during the first stage of drying is concurrent and during the latter stage is countercurrent in relation to the timber, then a low psychrometric difference is obtained during the period which is critical for the quality of the timber with an increasing psychrometric difference on either side of this point.

DETAILED DESCRIPTION

Figure 1:
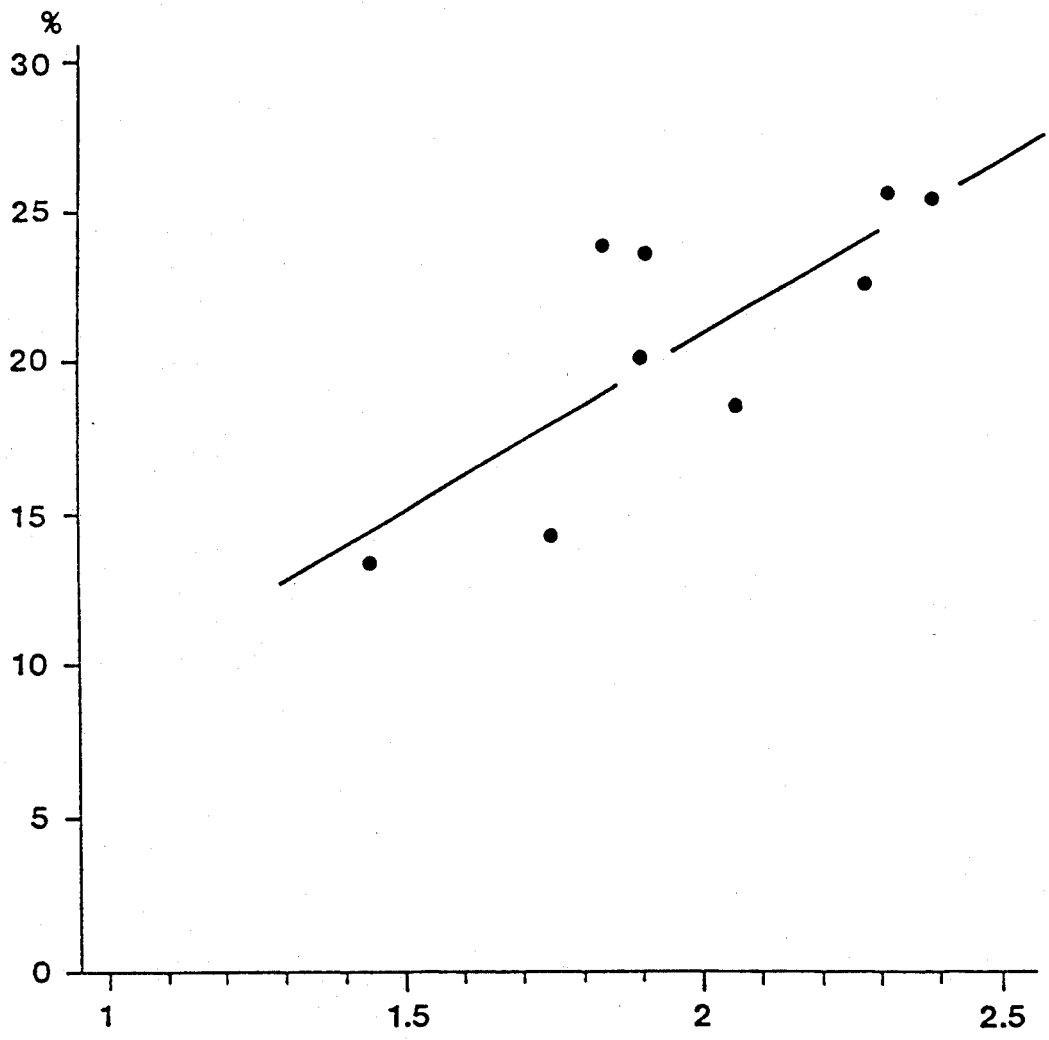
FIG. 1 is a chart showing quality loss versus respective drying schedules.

FIG. 1 is cited as an example of the loss prediction wherein the measured loss of value in percent is marked on the vertical axis for quality grades 1–3 of 75×150 mm redwood timbers with various drying schedules. The horizontal axis shows an index calculated for the respective drying schedules which sets the maximum tensile stress in relation to the strength of the timber. Taking into account the experimental difficulties of such tests, the correlation must be considered as entirely satisfactory.

Figure 2A:
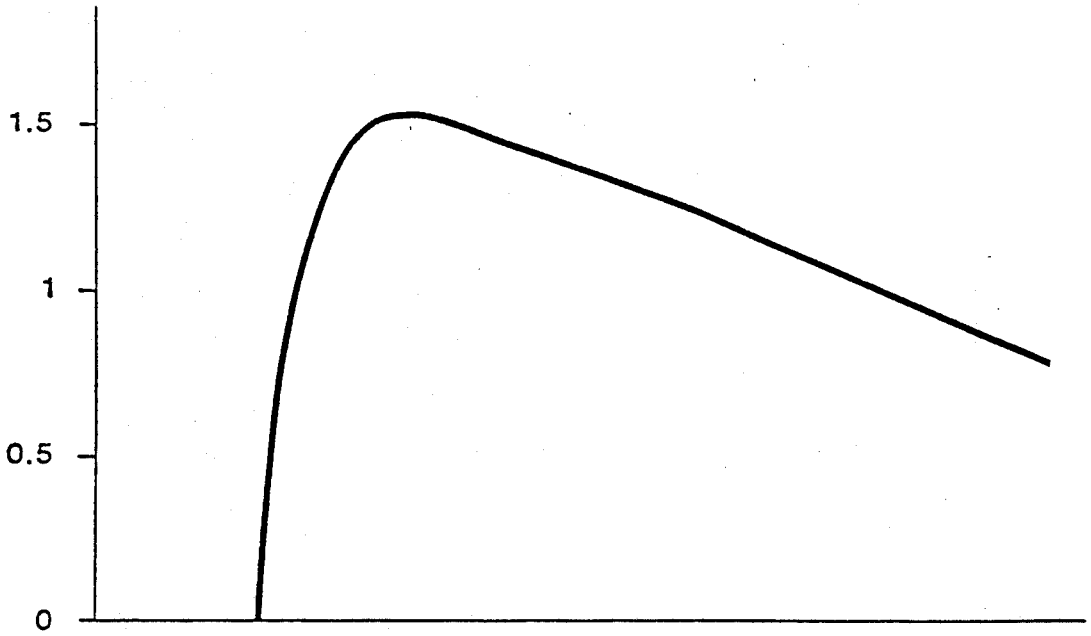
FIG. 2A is a chart showing tensile stress relative to drying time in a conventional kiln operation.
Figure 2B:
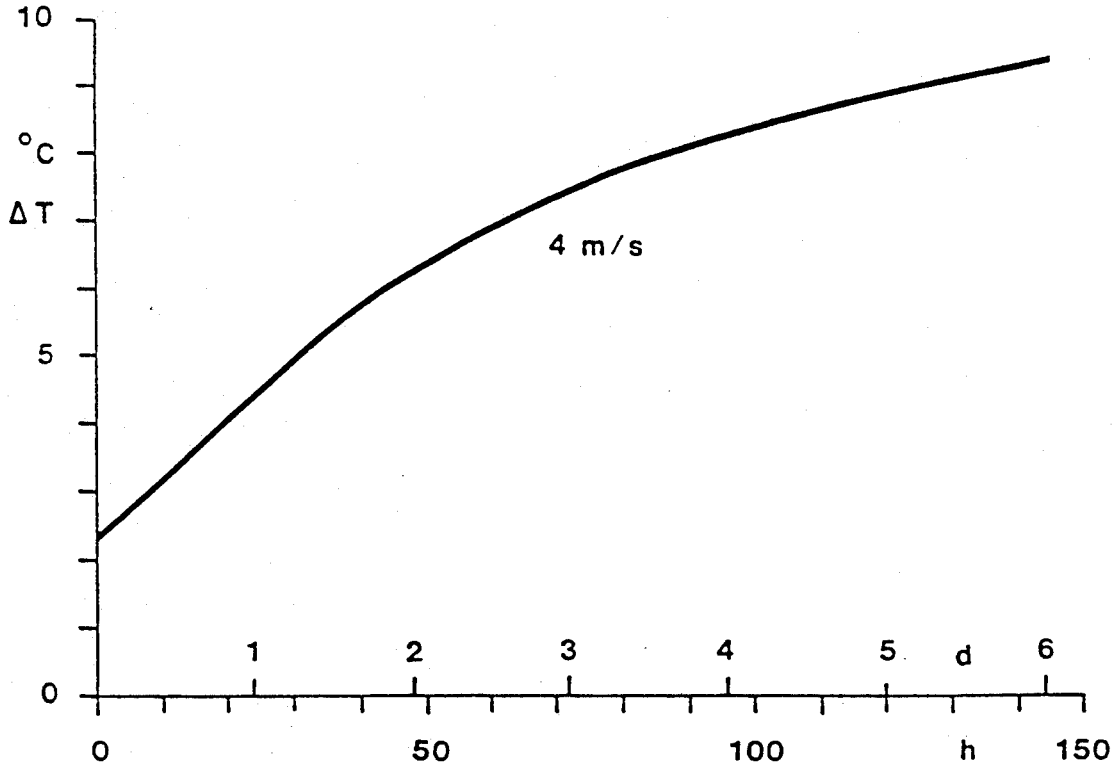
FIG. 2B is a chart showing psychrometric difference relative to drying time in a conventional kiln operation.

When a conventional single-stage progressive kiln is analyzed with the aid of model calculations of this kind, one obtains a picture which can be exemplified in FIGS. 2A and 2B. FIG. 2A shows on the vertical axis how the relative tensile stress in a 75×200 mm redwood timber changes as a function of the drying time expressed in days when the timber is dried from the fresh state down to a final moisture content of 19% in 6 days under normal conditions. FIG. 2B shows how the psychrometric difference (the difference between the dry-bulb and wet-bulb temperatures) varies in the timber pile when the drying air flows countercurrent through the timber with a speed of 4 m/s. From the figure, it can be stated that no stress occurs in the timber during the first 24 hours, since then the surface of the timber has not yet dried to below the fiber saturation point. After that, the stress rises rapidly to reach its maximum towards the end of the second day. The stress then decreases continuously during the entire remaining drying time. Since it is the maximum stress level which determines the risk of checking (FIG. 1), it can be seen that it is the psychrometric difference around the end of the second day that determines the quality loss of the timber. Both before and after this critical period, the psychrometric difference could be greater than the levels given in FIG. 2B. This, however, can naturally not be changed in a conventional progressive kiln.

It has now unexpectedly been discovered that these negative properties associated with the conventional progressive kiln can to a large extent be eliminated if the kiln is divided into two drying stages in an appropriate fashion.

Figure 3A:
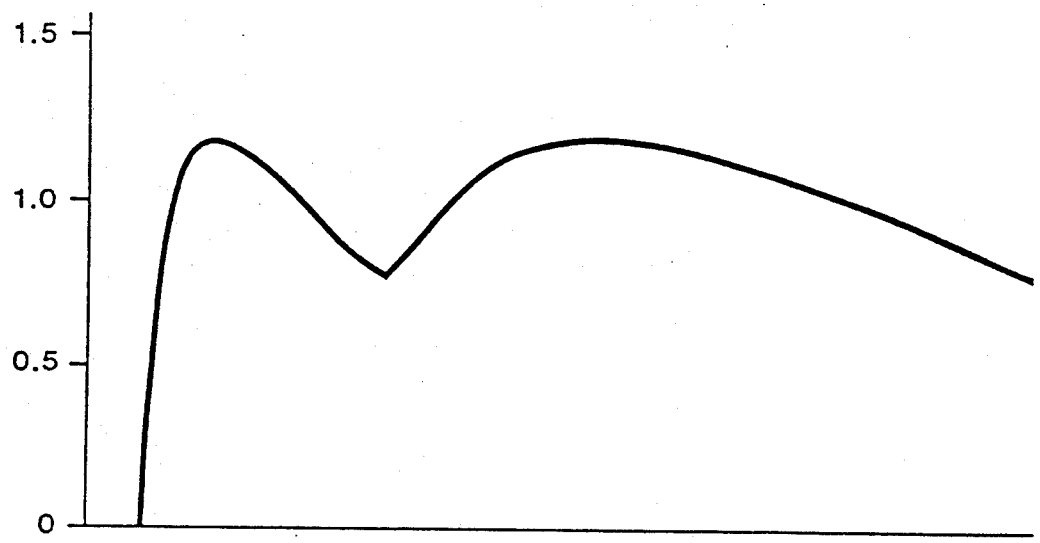
FIGS. 3A and 3B are similar to FIGS. 2A and 2B, but show the results achieved employing applicant's invention.
Figure 3B:
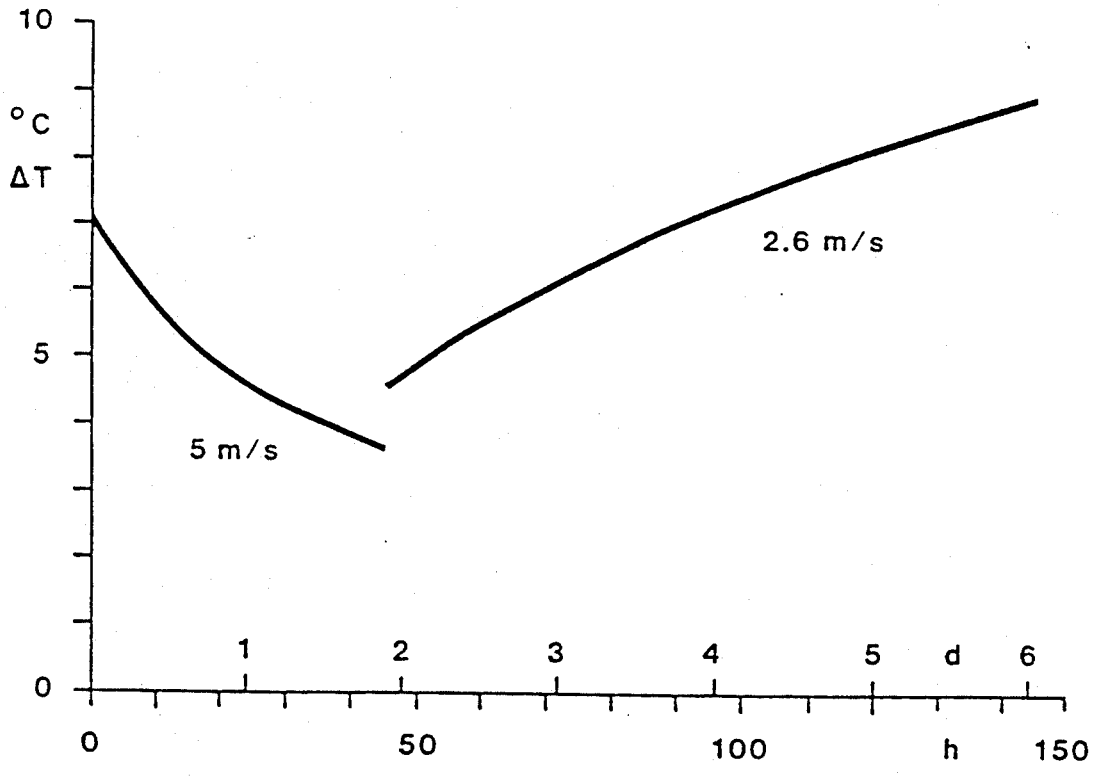

As an example of an embodiment of the invention, FIGS. 3A and 3B are presented. By the reversed direction of flow of the drying air during the first stage, the psychrometric difference (FIG. 3B) here decreases in time, which leads to a rapid drying in the beginning, so that the fiber saturation point is reached already after 12 hours, whereas the stress level (FIG. 3A) does not now rise as high as in FIG. 2A. During the second drying stage, the conditions differ from those in a conventional kiln only in that the speed of the drying air can now advantageously be kept somewhat lower (for example, 2.6 m/s) which gives a milder drying atmosphere during the critical period. The external conditions are unchanged both in the example concerning a conventional kiln (FIGS. 2A and 2B) and in the example concerning the two-stage drying in accordance with the invention, so that a direct comparison is possible. One then sees that the high stress peak in FIG. 2A has now been divided into two lower peaks. In the example in FIGS. 3A and 3B, the dividing point between the two stages and also the temperatures and speeds of the drying air have been chosen so that these two stress peaks are of equal height and on as low a level as possible. This is achieved if the first drying stage represents approximately ⅓ and the second stage correspondingly ⅔ of the entire drying time (length of the drying tunnel). Further, the speed of the drying air in the first stage is advantageously kept somewhat higher, and in the second stage somewhat lower than that which is normal in a conventional single-stage progressive kiln. The stress peaks in FIG. 3A are at an approximately 20% lower level than the stress peak in FIG. 2A, which leads to an appreciable reduction of the quality losses during drying (FIG. 1) without the drying time (capacity) being changed. Alternatively, this improvement obtained by means of the invention can be utilized so that the quality of the timber is kept unchanged but the drying time is shortened.

It may be noted that in the two-stage progressive kiln which was presented earlier, the direction of flow of the drying air in relation to the wood is countercurrent in the first stage and concurrent in the second, which naturally has the consequence that the psychrometric difference is greatest in the neighborhood of the critical drying period. With regard to the directions of flow this earlier design thus constitutes the worst imaginable alternative.

In U.S. Pat. No. 4,127,946, a drying method is described where drying is effected by internally generated superheated steam above 212° F., in an apparatus divided into two zones, where the steam in the first zone flows in a concurrent direction in relation to the material being dried, and in a countercurrent direction in the second zone. This method, which is recommended for drying of veneer and particulate material, however, has severe disadvantages when applied to timber drying. First, with temperatures above 212° F., severe surface darkening and resin problems will occur, as the drying time for timber is several orders of magnitude longer than for wood veneer. Secondly, timber piles cannot be fed nearly continuously into the dryer in the same way as veneer or particulate material, and this causes most of the steam to escape and being replaced by air during the insertion of a new pile. During a long period after each insertion, there will thus be an uncontrolled climate until the steam atmosphere is restored through internal steam generation and this causes checking of the timber. Third, it is of utmost importance in timber drying that the drying rate can be accurately regulated in order to avoid checking, but with superheated steam both measurements and regulation of steam properties (drying force) is difficult, especially in the longitudinal direction of the dryer. A temperature profile in that direction of the kind illustrated in FIG. 3A cannot be achieved.

It has now also unexpectedly been discovered that, although drying in accordance with the invention is divided into two stages, important process units can be made common to both stages, which appreciably simplifies the construction of the drying kiln without practically any effect on the quality-preserving properties of the invention. The kind of process units that can be made common are the heating unit for the drying air, fans for transport of the air through the timber, and the ventilation unit for maintenance of the desired air humidity.

As was apparent from FIGS. 3A and 3B, it is advantageous to maintain a higher air speed in the first stage than in the second drying state. Since, however, the number of timber piles in the first stage (tunnel length) is less than in the second stage this means that the flow pressure losses are almost equal in the two stages despite the different speeds. Accordingly, the air circulation in the two stages can be maintained by a single fan unit without the division of the air between the two stages departing significantly from that desired. Similarly, it is apparent from FIGS. 3A and 3B that the air flows which are led into each of one of the drying stages at the ends of the tunnel do not differ very much as to their condition. This shows that the quality advantages of the invention can be retained even if air with the same condition, i.e., from the same heating unit, is fed into both the drying stages.

Figure 4A:
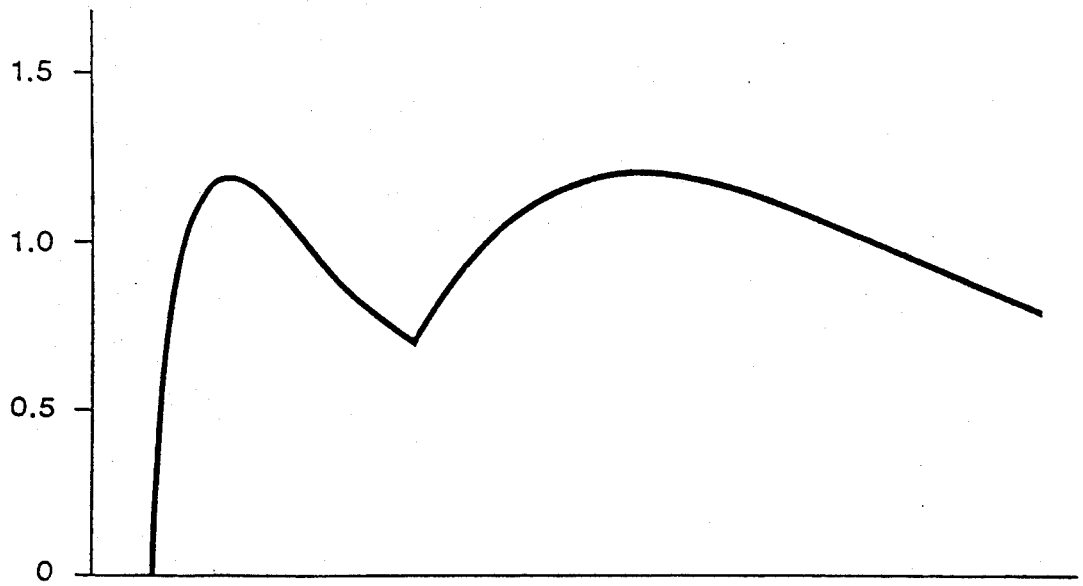
FIGS. 4A and 4B are similar to FIGS. 3A and 3B wherein the air speeds are matched and the pressure drops are the same over both drying stages.
Figure 4B:
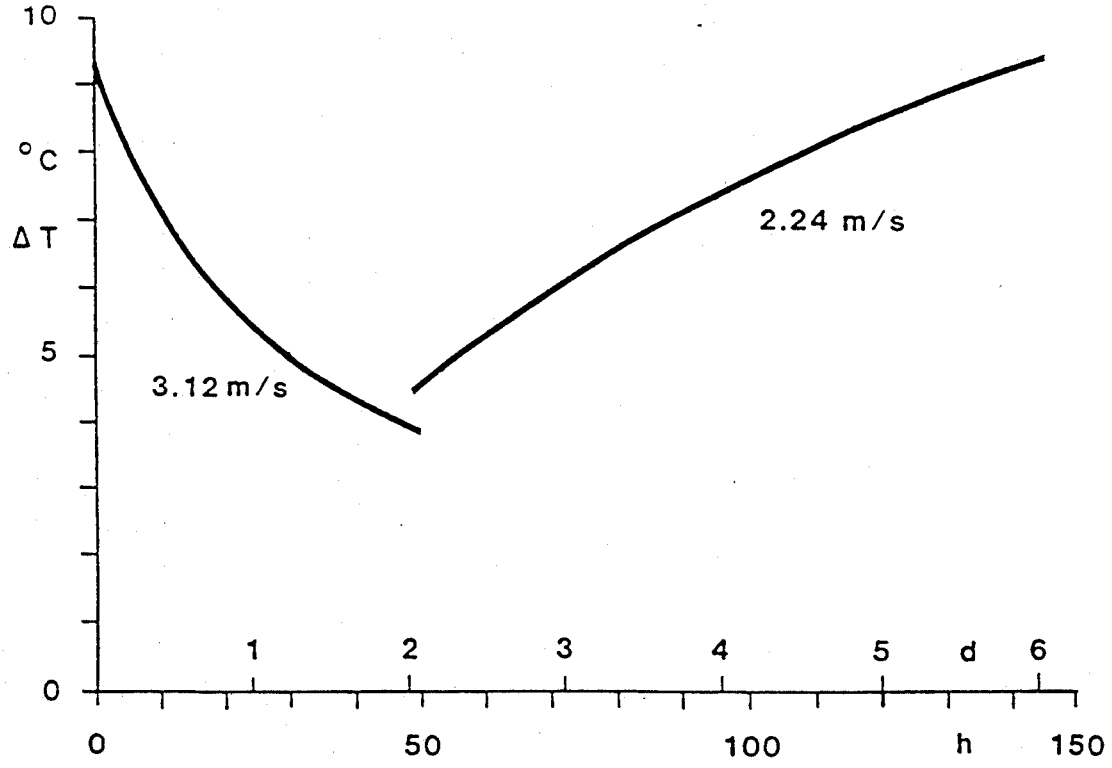

FIGS. 4A and 4B show an example comparable with FIGS. 2A and 2B and 3A and 3B and in which the same air (psychrometric difference 9.5° C.) is fed into both drying stages and in which the air speeds (3.12 and 2.24 m/s, respectively) are matched so that the pressure drops are the same, i.e., a situation which can be obtained using only a single common heating unit and a single fan unit. It is apparent from the FIG. 4A that the stress peaks are practically identical with the peaks in FIG. 3A. Further, it is found that the drying air from each of the stages has almost the same condition (psychrometric difference approximately 4° C.). Thus, it is of no major consequence for the energy consumption whether the exhaust of moist air from the kiln takes place from the first or the second stage or after mixing of the air from these stages, i.e., a common unit for exhaust of moist air and input of fresh air can be employed. An embodiment of the invention represented by FIGS. 4A and 4B shows that this two-stage drying tunnel is not to a decisive degree more complicated in its construction than a corresponding single-stage conventional drying tunnel but with the difference that the quality of the dried timber is considerably better despite an unchanged drying time. Alternatively, the drying time can be appreciably shortened without changing the quality compared with a single-stage drying tunnel.

Figure 5:
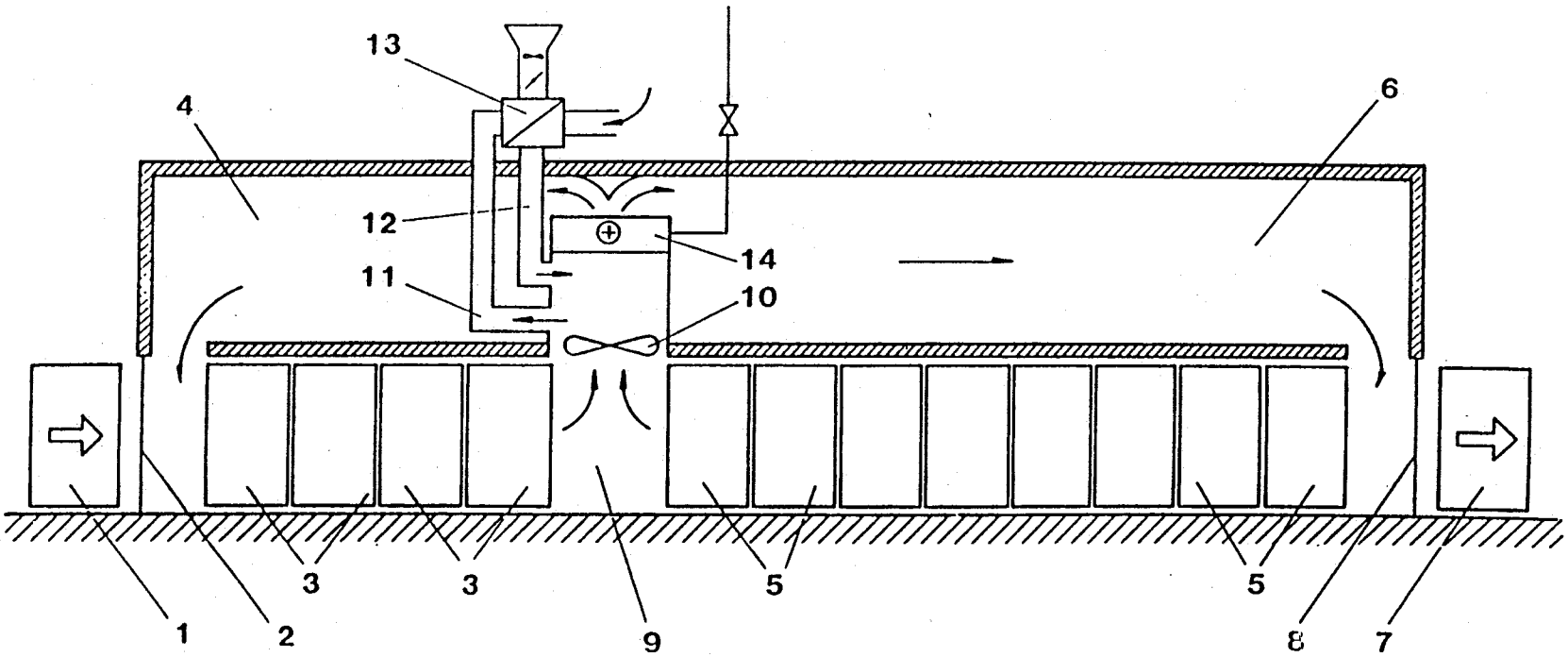
FIG. 5 is a cross-sectional view of a kiln embodying the invention.

An example of an embodiment of the invention is illustrated in FIG. 5, which shows a horizontal view in cross section of an arrangement for implementation of the present process. In the figure, timber pile 1 is waiting to be inserted into the drying tunnel through inlet door 2, timber pile 3 in the first drying section is permeated by drying air flowing in a concurrent direction from return tunnel 4. Timber pile 5 in the second drying section is permeated by drying air flowing in a countercurrent direction from return tunnel 6. After the second section, a dried pile of timber 7 is taken out through outlet door 8. After the respective drying sections, the drying air is sucked out from the intervening space 9 with the aid of fan unit 10 to the conditioning unit. In order to maintain the desired moisture content of the drying air, a portion of the drying air is sucked out through duct 11 and replaced with fresh air through duct 12. Part of the heat content in the exhaust air is recovered to the replacement air in heat exchanger 13. The drying air is heated to the desired temperature in hot-water or steam-heated-air heater 14 and is then conducted to said return tunnels 4 and 6. After the drying has progressed sufficiently, said doors 2 and 8 are opened and a wood pile 5 is taken out to position 7 after which the entire row of wood piles 3 and 5 is moved a step forward and a new wood pile is inserted from position 1 into the first drying section, after which the doors are closed and the drying process is continued.

It is intended to cover by the appended claims all embodiments which come within the true spirit and scope of the invention.

I claim:

1. A process for drying timber prone to checking caused by shrinkage induced stress in a drying tunnel, having an inlet and outlet, a first section adjacent the inlet of the tunnel and a second longer section adjacent the outlet of the tunnel through which each of said sections the timber is fed forward through a plurality of steps while being permeated by a drying air with a temperature below 80° C. transported primarily in the longitudinal direction of the tunnel, said drying tunnel provided with a drying medium divided into circulating substreams passing through each of said sections with the speed of the stream passing through the first section being higher than the speed of the stream passing through the second section, characterized in that one of said substreams is caused to flow through the first section of the tunnel in the direction of motion of the timber so that said one substream initially contacts the timber last fed into the tunnel and thereafter successively contacts timber that has dried a longer period and the other substream flows through the second section of the tunnel counter to the direction of motion of the timber so that said other substream initially contacts timber that has been dried the longest period and thereafter successively timber that has been dried a shorter period and the speed at which the timber flows through the drying tunnel is set so that when the timber reaches the juncture of the sections where the air streams meet there is a relatively low psychrometric difference between the timber and the air streams compared to the increasing psychrometric differences on either side of this juncture resulting in lower stress peaks and increased quality of timbers without change in drying time after which said substreams are thereafter conditioned and recirculated.

2. A process according to claim 1, characterized in that said substreams after contact with the timber are mixed and thereafter again divided into substreams which are conditioned and returned to their respective sections.

3. A process according to claim 1, characterized in that said substreams after contact with the timber are mixed and conditioned and thereafter again divided into two substreams which are returned to their respective sections.

4. A process according to claim 1, characterized in that the length of the first drying section constitutes approximately one-third of the effective length of the entire drying tunnel.

5. A process according to claim 1, characterized in that the recirculation of the drying medium is achieved by an organ which is common to both sections.

6. A process according to claim 2, characterized in that the length of the first drying section constitutes approximately one-third of the effective length of the entire drying tunnel.

7. A process according to claim 3, characterized in that the length of the first drying section constitutes approximately one-third of the effective length of the entire drying tunnel.

8. A process according to claim 2, characterized in that the recirculation of the drying medium is achieved by an organ which is common to both sections.

9. A process according to claim 3, characterized in that the recirculation of the drying medium is achieved by an organ which is common to both sections.

* * * * *